US006454432B1

(12) United States Patent
Avinger et al.

(10) Patent No.: US 6,454,432 B1
(45) Date of Patent: Sep. 24, 2002

(54) FLIP-TOP COVER FOR RECEPTACLE

(75) Inventors: Andrew G. Avinger; Stephen L. Fillipp, both of Lubbock, TX (US)

(73) Assignee: Emerald Innovations L.LC., Butler, PA (US)

( * ) Notice: Subject to any disclaimer, the term of this patent is extended or adjusted under 35 U.S.C. 154(b) by 0 days.

(21) Appl. No.: 09/684,133

(22) Filed: Oct. 10, 2000

(51) Int. Cl.[7] ..... A45C 15/06
(52) U.S. Cl. ..... 362/156; 362/154; 362/155
(58) Field of Search ..... 362/109, 154, 362/155, 156, 806; 202/495.01, 495.03, 495.06, 495.08, 558, 241, 244, 252, 780, 309, 376, 696, 810; 150/118, 119, 120; 206/45.2, 45.23, 457; 224/158, 159; 446/397, 484, 485

(56) References Cited

U.S. PATENT DOCUMENTS 1,878,406 A * 9/1932 Karper ..... 220/830
5,181,393 A * 1/1993 Lott ..... 62/264
5,597,230 A * 1/1997 Newman ..... 362/154
6,059,423 A * 5/2000 Knopick ..... 362/156
6,200,000 B1 * 3/2001 Burnidge ..... 362/155
6,224,234 B1 * 5/2001 Demmery ..... 362/156

* cited by examiner

*Primary Examiner*—Sandra O'Shea
*Assistant Examiner*—Ismael Negron
(74) *Attorney, Agent, or Firm*—Calfee, Halter & Griswold LLP

(57) ABSTRACT

A flip-top cover for a receptacle such as a plastic bag, the cover having a body, a flap member with a decorative face and a hinge rotatably connecting the flap member to the body, a handle attached in fixed relation to the decorative face, a power supply, an integrated circuit with light and sound generators, and a switch that activates the circuit upon rotation of the flap member relative to the body.

10 Claims, 4 Drawing Sheets

FLIP-TOP COVER FOR RECEPTACLE

BACKGROUND OF THE INVENTION

1. Field of the Invention

This invention relates to decorative containers, carriers, receptacles and the like that are useful as for carrying Halloween treats and, more particularly, to receptacles with cover members having selectively controllable light and sound generation devices.

2. Description of Related Art

Many types of Halloween treat carriers are well known. U.S. Pat. No. 5,597,230, for example, discloses a hollow carrier in the shape of an object such as a jack-o-lantern, having eye openings through which lights are visible when illuminated, the lights being battery-powered and controlled by a switch disposed in the handle.

SUMMARY OF THE INVENTION

The apparatus of the present invention is preferably a flip-top cover for a receptacle such as a plastic bag, the cover having a body, a flap member with a decorative face, and a hinge rotatably connecting the flap member to the body, the flap member also having a handle attached in fixed relation to the decorative face, a power supply, an integrated circuit with light and sound generators, and a switch that activates the circuit upon rotation of the flap member relative to the body. A preferred receptacle for use with the flip-top cover is a plastic bag having a draw string that can be tied in place around the lower body of the flip-top cover. Alternatively, other attachment devices such as one or more elastic bands can likewise be used for attaching the receptacle to the cover.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
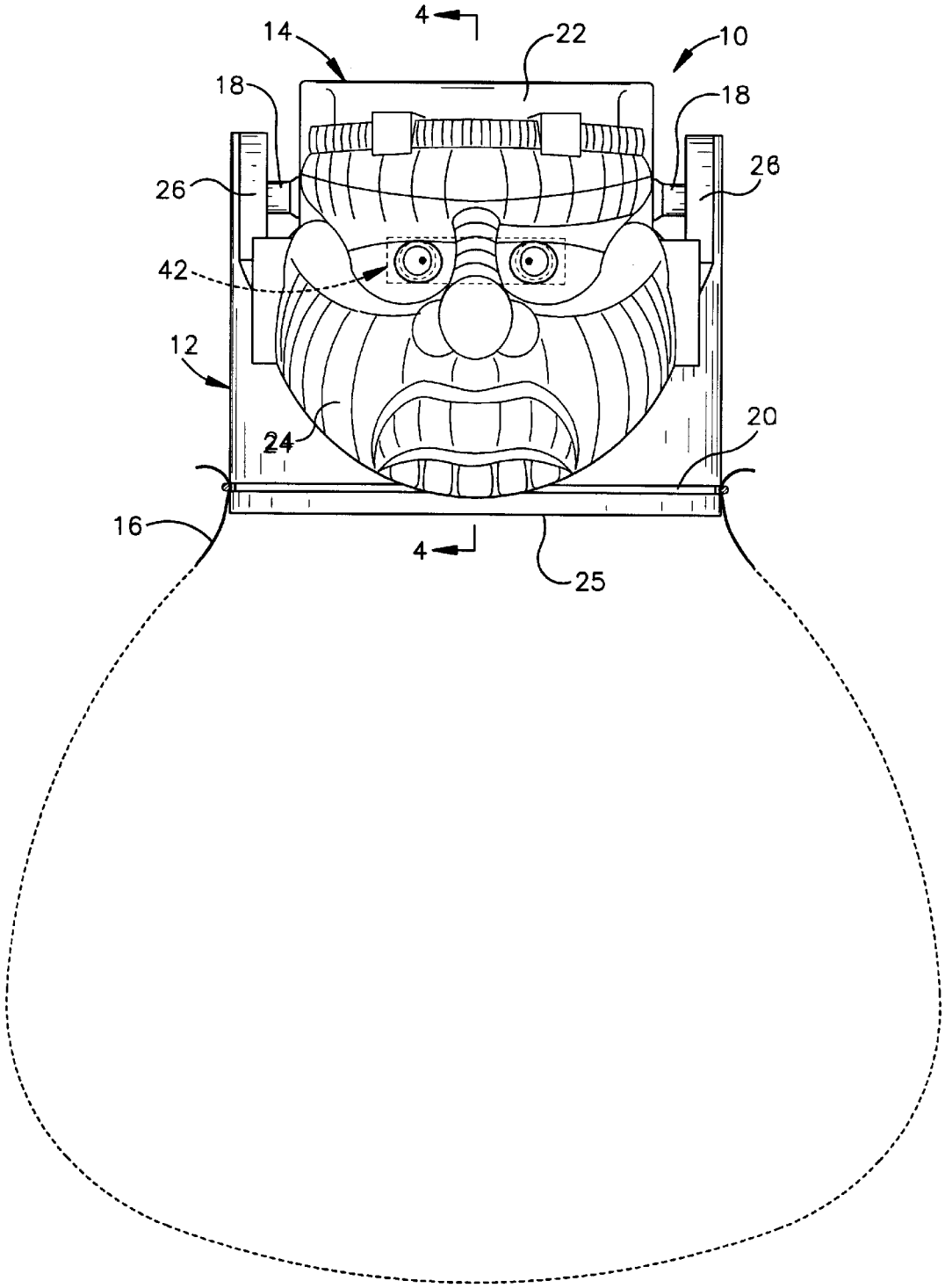
FIG. 1 is a simplified front elevation view of a preferred flip-top cover of the invention, with an attached receptacle shown in dashed outline.
Figure 2:
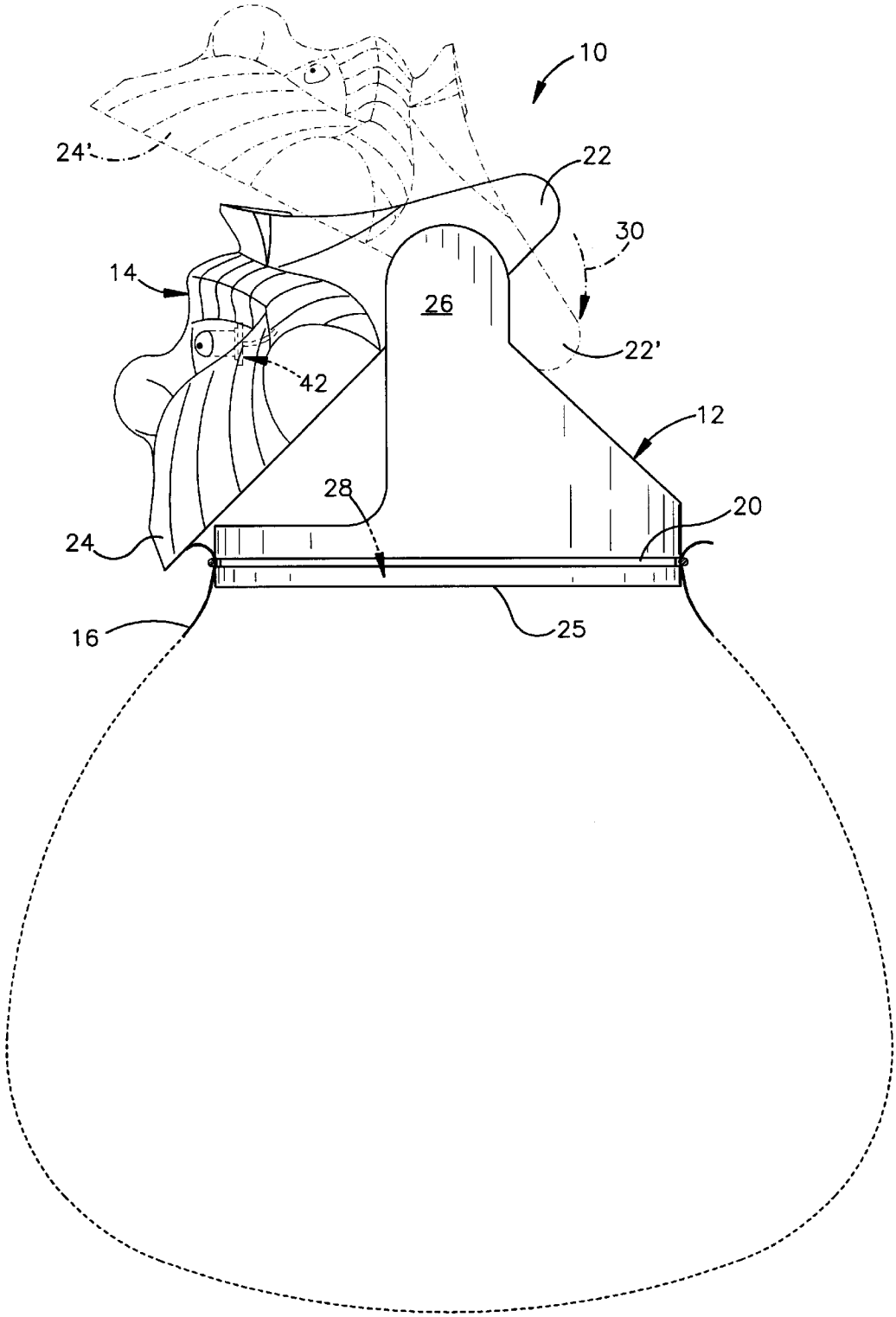
FIG. 2 is a side elevation view of the apparatus shown in FIG. 1.
Figure 3:
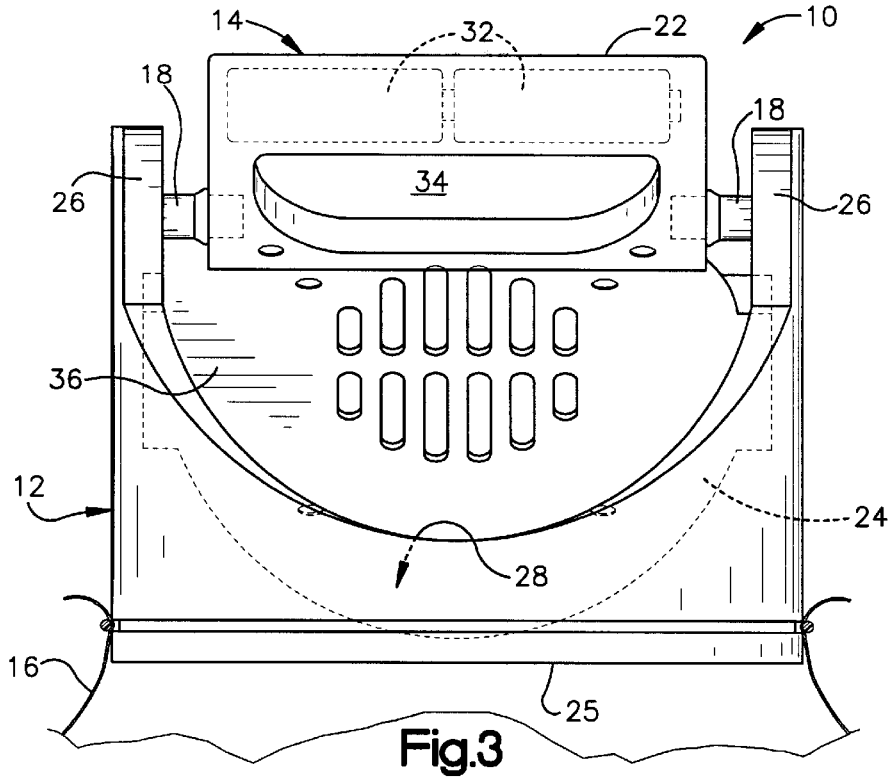
FIG. 3 is an enlarged rear elevation view of the flip-top cover of FIG. 1, with all but the upper portion of the receptacle broken away.

Referring to FIGS. 1–4, flip-top cover 10 of the invention preferably comprises body 12, flap member 14 and a hinge rotatably connecting the flap member to the body. In the preferred embodiment shown, the hinge comprises hinge pins 18 that are rotatably captured in hinge support members 26 on each side of body 12. Flap member 14 is preferably made of a moldable polymeric resin and most preferably comprises a face 24 having decorative features in the form of a creature, character, caricature or other decorative object. As depicted in FIGS. 1–4, the decorative features of flip-top cover 10 are all embodied in face 24. It is understood, however, that other decorative features can be embodied in body 12, so that both the body and flap member cooperate to present an even more pronounced decorative effect. Receptacle 16, depicted in the drawings as a bag, can take any of many different forms and can be flexible, rigid or semi-rigid as desired. Where receptacle 16 is a bag, it can be conveniently made to be releasably attachable to body 12 of flip-top cover 10 using a drawstring in the top of the bag or, as depicted, an elastic band 20 stretched around body 12 slightly above base 25. If desired, a recess 19 as seen in FIG. 3 can be provided around the perimeter of body 12 to facilitate holding elastic band 20 in place. This can be particularly desirable where receptacle 16 is used, for example, for carrying Halloween treats whose weight might otherwise cause receptacle 16 to disengage from body 12.

Flap member 14 preferably further comprises handle 22 connected in fixed relation to decorative face 24. As shown in FIGS. 1–4, handle 22 is integrally molded with face 24 and is oriented parallel to hinge pins 18. A direct current power supply such as at least one AA or AAA battery is desirably disposed inside handle 22. Referring to FIG. 3, batteries 32 are depicted in simplified form as installed inside handle 22, which contains cylindrical cavity 40, visible in FIG. 4. Access to cavity 40 is provided by the removal of battery cover 62 attached by screw 64 or another similarly effective means. Space 34, seen in FIG. 3, is a void permitting handle 22 to be grasped by the hand of the user. When handle 22 of flap member 14 is rotated rearwardly around the hinge, face 24 elevates away from body 12, providing access to the interior of body 12 and to opening 28 in base 25 of body 12 and the open top of receptacle 16.

Figure 4:
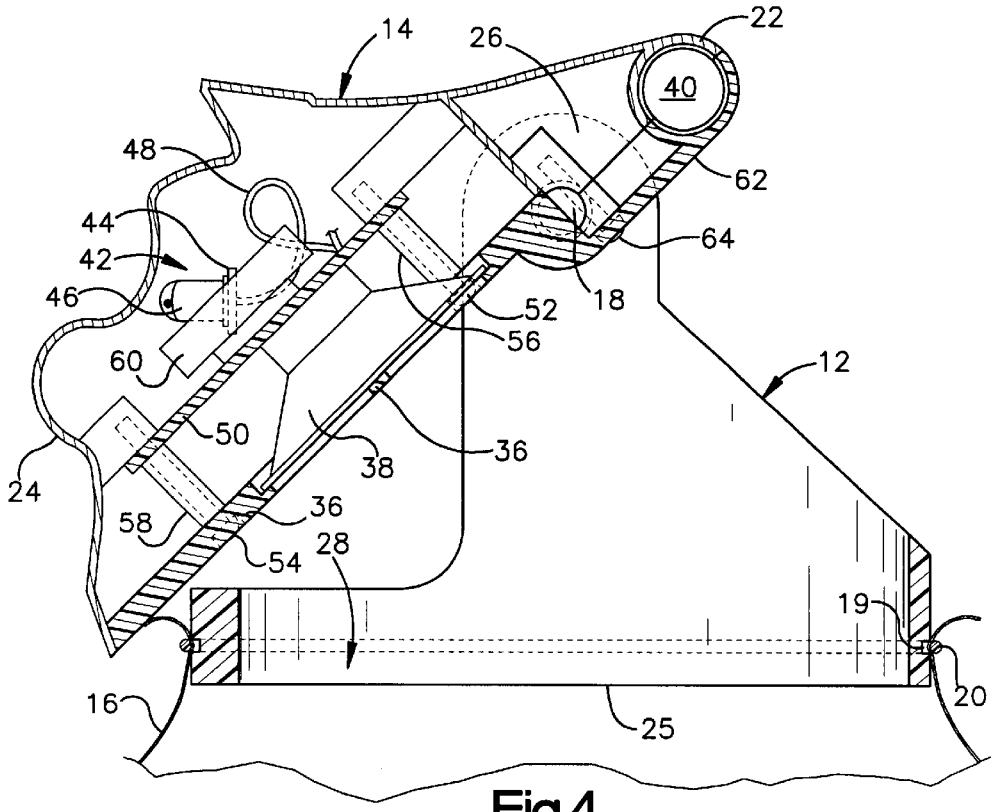
FIG. 4 is a cross-sectional view taken through line 4—4 of FIG. 1.

Referring to FIG. 4, body 12 preferably comprises printed circuit board 50 secured to body 14 by screws 52, 54 inserted through bosses 56, 58 on the back side of speaker cover plate 36 (also visible in FIG. 3). The circuit board preferably further comprises an integrated circuit having a conventional programmable control chip, including a digital memory device, that is electronically interconnected when activated by switch 60 to selectively energize lighting device 42 and a sound generating device or transducer such as speaker 38. Switch 60 can be any suitable commercially available, motion-activated switch or other mechanical switch that causes the integrated circuit to energize lighting device 42 and speaker 38 when flap member 14 is rotated to the open position relative to body 12. Contacts for switch 60 can be disposed on hinge pins 18 and hinge support member 26 if desired. Lighting device 42 preferably further comprises support frame 44 having at least one, and preferably two or more, light bulbs or light emitting diodes 46 that are cooperatively aligned with apertures or transparent or translucent panels in the front of face 24 so as to be visible when lighted. In the embodiment shown, light emitting diodes 46 function as simulated eyes of the decorative figure whose image is embodied in face 24. Light emitting diodes 46 are attached to circuit board 50 by electrical conductors 48.

Figure 5:
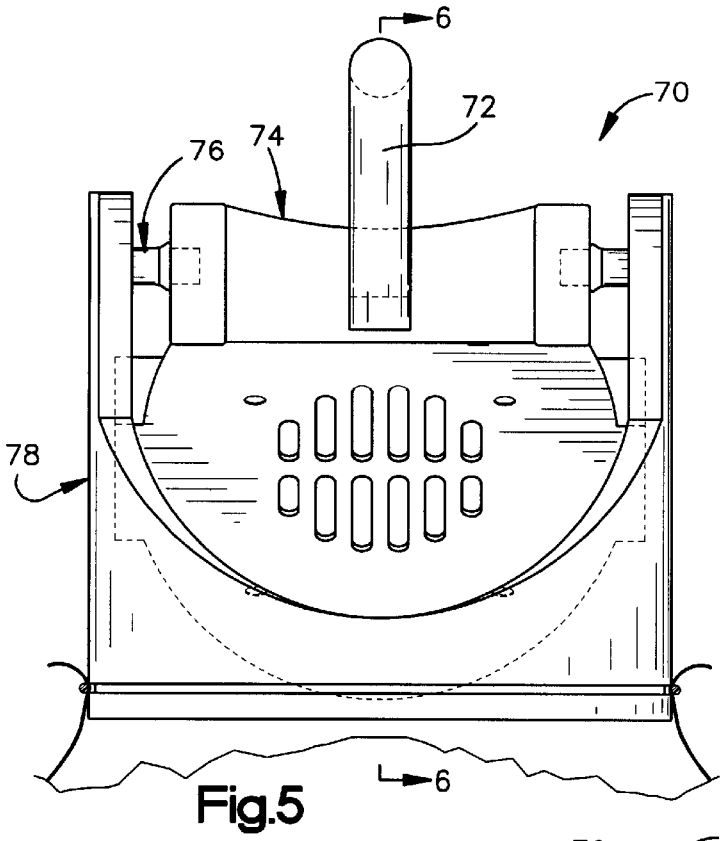
FIG. 5 is a rear elevation view of another preferred embodiment of the flip-top cover of the invention having an upwardly projecting handle member mounted transversely to the rotational axis of the hinge.
Figure 6:
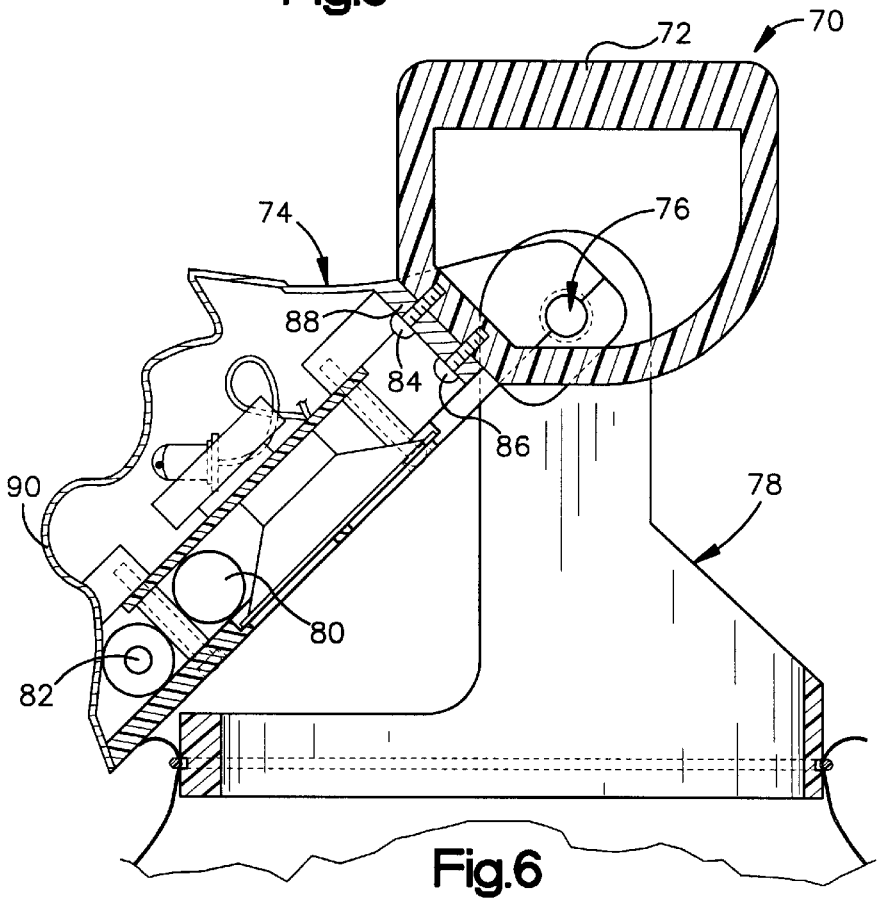
FIG. 6 is a cross-sectional view taken along line 6—6 of FIG.5.

Referring to FIGS. 5 and 6, another preferred flip-top cover 70 is shown that comprises flap member 74 connected by rotatable hinge 76 to body 78, all of which can be made substantially as previously described. In this embodiment, however, handle member 72 of flap member 74 is upwardly projecting and is transverse to the rotational axis of hinge 76. Hinge 72 is desirably connected to flap member 74 by screws 84, 86 inserted through body wall 88, and batteries 80, 82 are disposed inside face 90 of flap member 74 rather than inside a cavity in handle 72 as described in relation to the prior embodiment.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A flip-top cover for a receptacle, the cover comprising a body, a flap member with a decorative face, and a hinge rotatably connecting the flap member to the body, the flap member further comprising a handle connected in fixed relation to the decorative face, a power supply, an integrated circuit with light and sound generating devices, and a switch that activates the circuit upon rotation of the flap member relative to the body.

2. The flip-top cover of claim 1 wherein the receptacle is a plastic bag.

3. The flip-top cover of claim 1 wherein the receptacle is attached to the body by a drawstring.

4. The flip-top cover of claim 1 wherein the receptacle is attached to the body by an elastic ring.

5. The flip-top cover of claim 1 wherein the light generating device comprises at least one light emitting diode.

6. The flip-top cover of claim 1 wherein the sound generating device comprises a speaker.

7. The flip-top cover of claim 1 wherein the handle is disposed in parallel relation to the hinge.

8. The flip-top cover of claim 1 wherein the handle is disposed in transverse relation to the hinge.

9. The flip-top cover of claim 1 wherein the power supply comprises at least one battery disposed inside the handle.

10. The flip-top cover of claim 1 wherein the power supply comprises at least one battery covered by the face.

* * * * *